US009998838B2

(12) United States Patent
Santek

(10) Patent No.: US 9,998,838 B2
(45) Date of Patent: Jun. 12, 2018

(54) MIDDLE EAR TRANSDUCER WITH BIOCOMPATIBLE IMPLANTABLE ADHESIVE PAD

(71) Applicant: Vibrant Med-El Hearing Technology GmbH, Innsbruck (AT)

(72) Inventor: Michael Santek, Innsbruck (AT)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 209 days.

(21) Appl. No.: 14/898,762

(22) PCT Filed: Jun. 17, 2014

(86) PCT No.: PCT/US2014/042606
§ 371 (c)(1),
(2) Date: Dec. 16, 2015

(87) PCT Pub. No.: WO2014/204880
PCT Pub. Date: Dec. 24, 2012

(65) Prior Publication Data

US 2016/0142837 A1 May 19, 2016

Related U.S. Application Data

(60) Provisional application No. 61/836,243, filed on Jun. 18, 2013.

(51) Int. Cl.
*H04R 25/00* (2006.01)

(52) U.S. Cl.
CPC ..... *H04R 25/608* (2013.01); *H04R 25/606* (2013.01)

(58) Field of Classification Search
CPC ..... H04R 25/606–25/608; H04R 25/65; H04R 2460/13
See application file for complete search history.

(56) References Cited

U.S. PATENT DOCUMENTS 5,259,032 A 11/1993 Perkins et al.
6,592,513 B1 7/2003 Kroll et al.
(Continued)

OTHER PUBLICATIONS

United States Receiving Office, International Search Report, International Application No. PCT/US2014/04260 dated Oct. 28, 2014 together with the Written Opinion, 15 pages.

*Primary Examiner* — Thaddeus Cox
(74) *Attorney, Agent, or Firm* — Sunstein Kann Murphy & Timbers LLP

(57) ABSTRACT

An implantable transducer converts an electrical stimulation signal into a corresponding mechanical stimulation signal. The transducer has an elongated shape with a transducer end face having a transducer drive surface adapted to produce the mechanical stimulation signal, and a transducer adhesive feature adapted to intra-operatively receive adhesive material. A separate coupling cap has a coupling end face with a coupling adhesive feature adapted to engage the transducer adhesive feature with the adhesive material and a coupling drive surface adapted for distortion-free coupling of the mechanical stimulation signal from the transducer drive surface to the coupling cap. A signal delivery surface of the coupling cap delivers the mechanical stimulation signal to an adjacent cochlear surface for sensation as sound.

22 Claims, 5 Drawing Sheets

(56) References Cited

U.S. PATENT DOCUMENTS

| | | | | |
|---|---|---|---|---|
| 6,730,015 | B2 * | 5/2004 | Schugt | A61N 1/375 600/25 |
| 2002/0038072 | A1 | 3/2002 | Muller et al. | |
| 2003/0123687 | A1 * | 7/2003 | Petrick | H04R 25/60 381/322 |
| 2004/0147804 | A1 * | 7/2004 | Schneider | H04R 25/606 600/25 |
| 2006/0058573 | A1 * | 3/2006 | Neisz | H04R 25/606 600/25 |
| 2010/0324355 | A1 | 12/2010 | Spitaels et al. | |
| 2011/0178364 | A1 * | 7/2011 | Ball | A61F 2/18 600/25 |
| 2012/0245407 | A1 | 9/2012 | Ball | |

* cited by examiner

MIDDLE EAR TRANSDUCER WITH BIOCOMPATIBLE IMPLANTABLE ADHESIVE PAD

This application claims priority from U.S. Provisional Patent Application 61/836,243, filed Jun. 18, 2013, which is incorporated herein by reference.

TECHNICAL FIELD

The present invention relates to medical implants, and more specifically to a novel clover shape attachment for securing an implantable floating mass transducer to the incus bone in the middle ear of a patient.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window and round window openings of the cochlea 104. The cochlea 104 is a long narrow organ wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 113 reside. In response to received sounds transmitted by the middle ear 103, the fluid-filled cochlea 104 functions as a transducer to generate electric pulses which are transmitted to the cochlear nerve 113, and ultimately to the brain.

Hearing is impaired when there are problems in the ear's ability to transduce external sounds into meaningful action potentials along the neural substrate of the cochlea 104. To improve impaired hearing, various types of hearing prostheses have been developed. For example, when a hearing impairment is related to the operation of the middle ear 103, a conventional hearing aid or a middle ear implant (MEI) device may be used to provide acoustic-mechanical vibration to the auditory system.

FIG. 1 also shows some components in a typical MEI arrangement where an external audio processor 111 processes ambient sounds to produce an implant communications signal that is transmitted through the skin by external transmitter 107 to an implanted receiver 108. Receiver 108 includes a receiver coil that transcutaneously receives the implant communications signal which is then demodulated into transducer stimulation signals which are sent over leads 109 through a surgically created channel in the temporal bone to a floating mass transducer (FMT) 110 secured to the incus bone in the middle ear 103. The transducer stimulation signals cause drive coils within the FMT 110 to generate varying magnetic fields which in turn vibrate a magnetic mass suspended within the FMT 110. The vibration of the inertial mass of the magnet within the FMT 110 creates vibration of the housing of the FMT 110 relative to the magnet. This vibration of the FMT 110 is coupled to the incus in the middle ear 103 and then to the cochlea 104 and is perceived by the user as sound. See U.S. Pat. No. 6,190,305, which is incorporated herein by reference.

FIG. 2A shows an FMT 110 ideally implanted so that its end drive surface 203 generates a mechanical stimulation signal that optimally drives the round window membrane 202 to vibrate the fluid within the scala tympani 201. In some patients, it may be difficult or impossible to implant the FMT 110 as shown in FIG. 2A with its cylindrical axis perpendicular to the round window membrane 202. When the patient's anatomy does not allow placement of the FMT 110 perpendicular to the round window membrane 202, FIG. 2B shows an FMT 110 that drives the round window membrane 202 via a vibroplasty coupling cap 204 within a round drive surface that drives the round window membrane 202 at an angle to the longitudinal axis of the FMT 110.

But implanting the FMT 110 with such a coupling cap 204 can be difficult. Because the FMT 110 and the coupling cap 204 are so small, they can be hard to handle and manipulate with standard non-custom surgical tools. It can be difficult for the surgeon to correctly place the coupling cap 204 coaxially onto the FMT 110 at a right angle. In other cases, the coupling cap 204 is initially placed correctly onto the FMT 110, but then gets pushed askew or off during the surgery (the holding force of the clamping fingers on the coupling cap 204 is limited). Or the surgeon may accidentally damage the FMT 110 and/or the coupling cap 204. These problems can arise due to various factors, for example, stress or poor lighting, and they can become quite time consuming to correct.

In addition, the arrangement as shown in FIG. 2 where the coupling cap 204 has clamping fingers that fit over the FMT 110 increases the outside diameter of the resulting arrangement which undesirably increases the volume needed for implantation.

Nor is it the case that a conventional adhesive material can simply be added to increase the bonding force between the FMT 110 and the coupling cap 204. There is no way to apply the same amount of adhesive material in the same repeatable way to bond the FMT 110 and the coupling cap 204 so as to provide a consistent and predictable effect in the operating performance of the implanted FMT 110. The adhesive material also has elastic properties that generated undesired linear and non-linear damping in the mechanical stimulation signal that is coupled between the FMT 110 and the coupling cap 204. In addition, evaporating the dilutant component of the adhesive material during surgery takes significant time and requires complicated sterile-safe procedures and other procedures that ensure that the toxic dilutant safely and completely evaporates. The only acceptable adhesive for use in an implantation application is fibrin glue, which is only intended for use with tissue, not mechanical components such as an FMT 110. A further challenge is to achieve an acceptably precise alignment of the coupling cap 204 with the FMT 110.

SUMMARY

Embodiments of the present invention are directed to an implantable transducer such as an FMT that converts an electrical stimulation signal into a corresponding mechanical stimulation signal. The transducer has an elongated shape with a transducer end surface having a transducer drive surface adapted to produce the mechanical stimulation signal, and a transducer adhesive feature adapted to intra-operatively receive adhesive material. A separate coupling cap has a coupling end face with a coupling adhesive feature adapted to engage the transducer adhesive feature with the adhesive material and a coupling drive surface adapted for distortion-free coupling of the mechanical stimulation signal from the transducer drive surface to the coupling cap. A signal delivery surface of the coupling cap delivers the mechanical stimulation signal to an adjacent cochlear surface for sensation as sound.

At least one adhesive feature may be an adhesive recess adapted to receive the adhesive material, in which case, the other adhesive feature may be an adhesive projection adapted to engage the adhesive recess. The adhesive recess may be located at a radial center of the end faces. Or the adhesive recess may be located around a circumference of the end faces. The transducer drive surface and the coupling drive surface may be flat. The adhesive features may be rougher than the drive surfaces to promote adhesive bonding with the adhesive material.

Applying the adhesive material may include applying heat of between 60° C. and 80° C. to promote evaporation of volatile components of the adhesive material, and/or reducing air pressure around the middle ear transducer arrangement.

DETAILED DESCRIPTION

Embodiments of the present invention are directed to a middle ear transducer arrangement with a vibroplasty coupling cap that is adapted for use with an adhesive material in a controlled consistent way that is reproducible and predictable, especially in that is distortion-free engagement between the drive surfaces of the transducer and the coupling cap to couple the mechanical stimulation signal free from damping and distortion.

Figure 3:
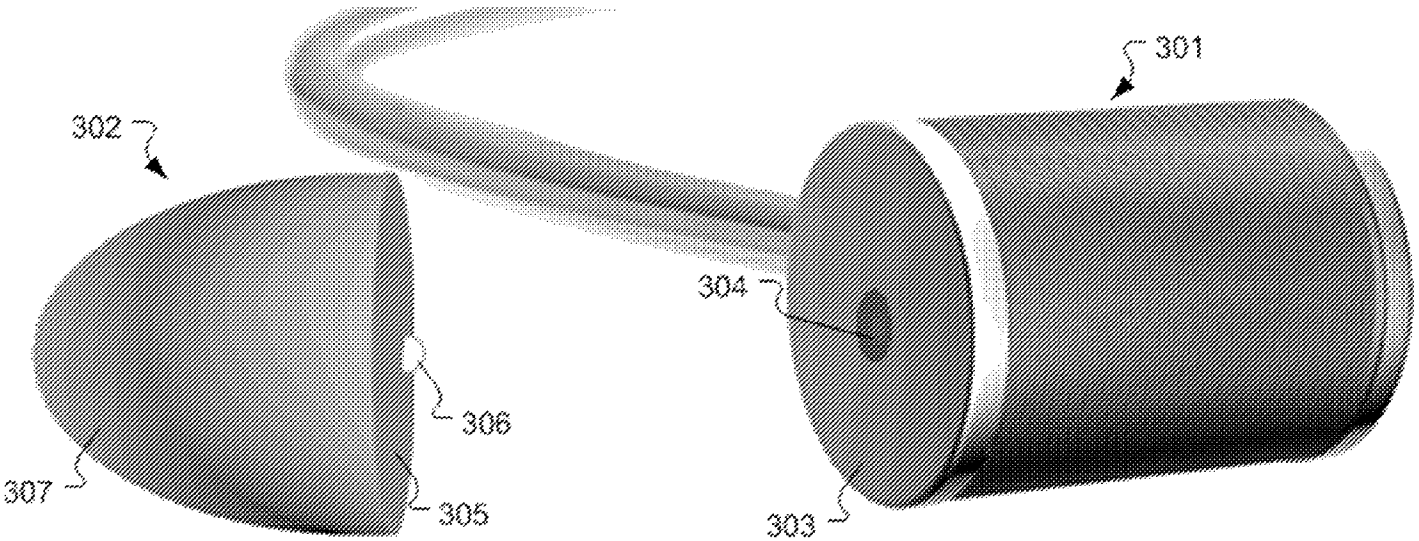
FIG. 3 shows a middle ear transducer and coupling cap that are adapted for use with an adhesive material according to one embodiment of the present invention.

FIG. 3 shows a middle ear transducer 301 and coupling cap 302 that are adapted for use with an adhesive material according to one embodiment of the present invention. In this case, the transducer 301 is an FMT that converts an electrical stimulation signal into a corresponding mechanical stimulation signal. The transducer 301 may have a cylindrical or rectangular shape, or any other suitable shape. One end face of the transducer 301 acts as a transducer drive surface 303 that is adapted to produce the mechanical stimulation signal. The end face of the transducer 301 also includes a transducer adhesive feature 304 that is adapted to intra-operatively receive adhesive material.

A separate coupling cap 302 includes a signal delivery surface 307 for delivering the mechanical stimulation signal from the transducer 301 to an adjacent cochlear surface for sensation as sound. A coupling end face includes a coupling adhesive feature 306 that is adapted to engage the transducer adhesive feature 304 and the adhesive material to fixedly connect the coupling cap 302 and the transducer 301. A coupling drive surface 305 is adapted for distortion-free engagement with the transducer drive surface 303 to couple the mechanical stimulation signal from the transducer 301 to the coupling cap 302.

Intra-operatively during the surgery to implant the transducer arrangement, the surgeon may decide to attach a coupling cap 302 to the transducer 110. Alternatively, it may be desirable to attach the coupling cap 302 to the transducer 301 during the manufacturing process. Rather than simply allowing the adhesive material to form a smooth bonding layer between the transducer 301 and the coupling cap 302, it is preferred to avoid distributing adhesive material over the entire connecting area. That is, the transducer drive surface 303 and the coupling drive surface 305 preferably should contact each other directly without adhesive to allow direct coupling of the mechanical stimulation signal from the transducer 301 to the coupling cap 302 without damping or other linear or non-linear distortion caused by the elastic properties of the adhesive material.

In the specific embodiment shown in FIG. 3, the coupling adhesive feature 306 is in the specific form of an adhesive recess at the radial center of the end face of the coupling cap 302 that is adapted to receive the adhesive material. The recess shape of the coupling adhesive feature 306 should be sufficiently large to promote control of the dispensing process of the adhesive material so as to correctly measure and reliably dispense the right amount during manufacturing. The recess may have a rough inner surface to further promote adhesive bonding with the dispensed adhesive material during manufacturing process. The transducer drive surface 303 and optionally the coupling drive surface 305 may have a smooth or rough surface, which may be flat, concave, or a hybrid concave and flat shape.

In one embodiment the transducer adhesive feature 304 may be coated with an adhesive friendly material, such as for example silicone. In FIG. 3, the transducer adhesive feature 304 is shown in the specific form of an adhesive recess at the radial center of the end face of the transducer 301 that adapted to receive the adhesive material and promoting self-alignment. For example the shape of the recess may be conical or any other suitable shape, for example, one with a trapezoidal cross-section. In general, any shape recess will be acceptable where the edge of the transducer adhesive feature 304 and the transducer drive surface 303 forms an obtuse angle suitable for self-alignment. The coupling adhesive feature 306 is formed as an adhesive projection located at the radial center of the coupling drive surface 305 that is adapted to engage the e.g. recessed shape of the transducer adhesive feature 304. The flat outer ring transducer drive surface 303 and coupling drive surface 305 do not contain any adhesive material, which allows for an adhesive-free direct connection and distortion free propagation of the mechanical stimulation signal.

Figure 1:
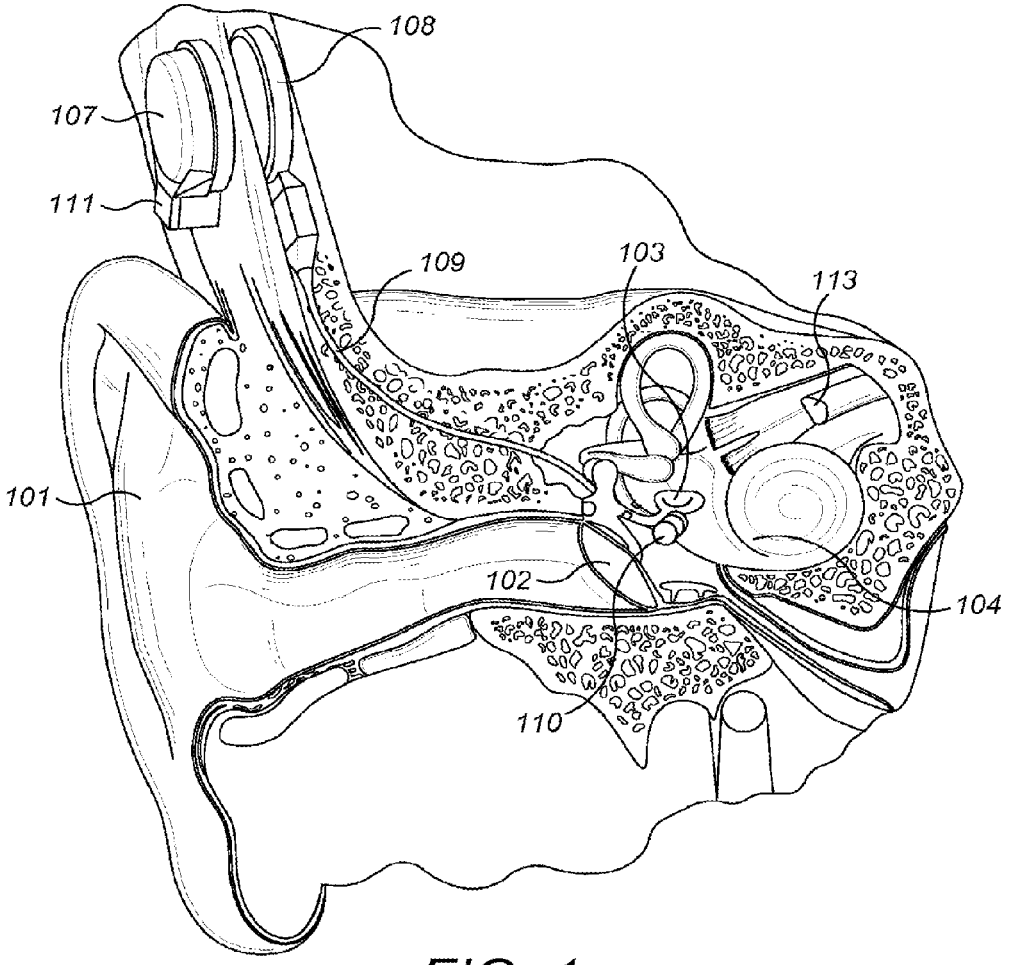
FIG. 1 shows various anatomical structures in a human ear containing a middle ear implant device.
Figure 2A:
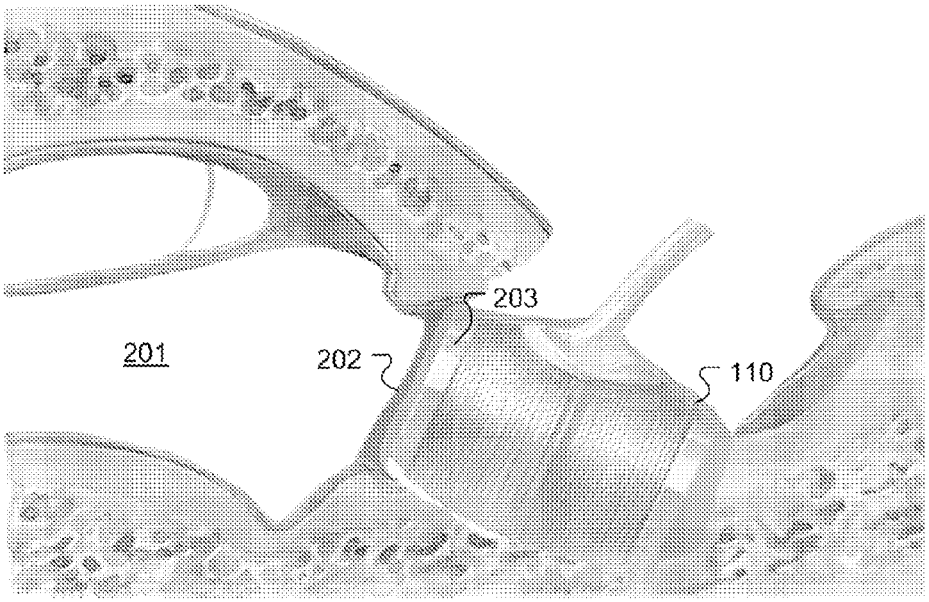
FIG. 2 A-B show anatomical details of implanted FMT devices.
Figure 2B:
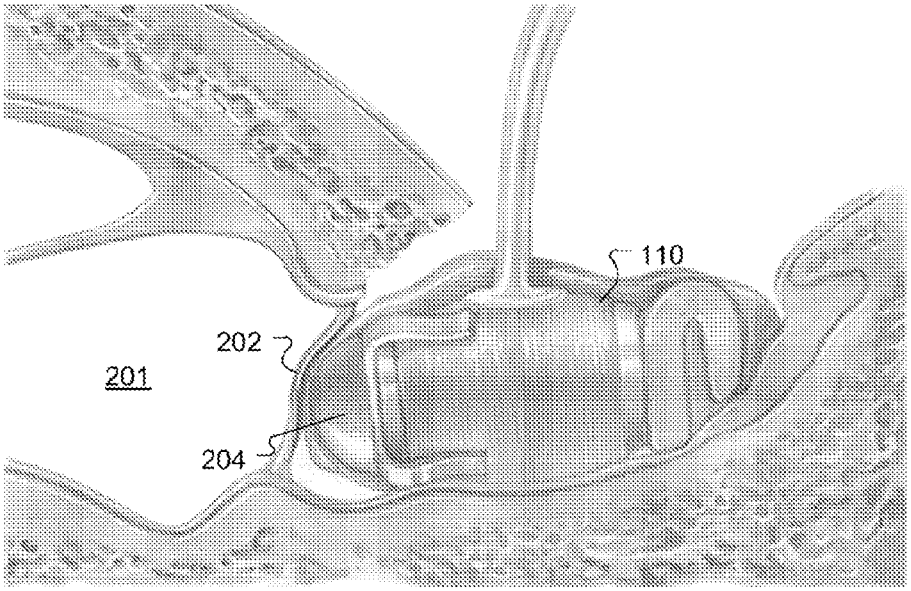

During surgery, a protective shipping sheet is removed from the coupling drive surface 305 and coupling adhesive feature 306 of the coupling cap 302. The transducer drive surface 303 and the coupling drive surface 305 are gently pressed together by the surgeon. This brings the coupling adhesive feature 306 at least partially into contact with the transducer adhesive feature 304. In some cases the surgeon will be able to perfectly align the coupling cap 302 and transducer 301 perfectly so that the coupling adhesive feature 306 and transducer adhesive feature 304 are lying exactly upon one another. But in most cases the coupling cap 302 and transducer 301 will be slightly misaligned so that the most protruding point of the coupling adhesive feature 306 projection (i.e., the center) contacts the transducer adhesive feature 304. This binds the coupling adhesive feature 306 to the adhesive friendly surface of the transducer adhesive feature 304 first and simultaneously avoids binding to the transducer drive surface 303 and promotes self-alignment. This self-alignment characteristic aids handling during surgery and provides form-locking fitting. After removal of the protective shipping sheet, the coupling adhesive feature 306 is exposed to air and a chemical curing process begins. Typically this chemical curing takes less than a minute during which the coupling cap 302 will self-align and afterwards the shrunken adhesive feature 306 exerts a compressive force, thereby fixedly connecting the transducer 301 and coupling cap 302 which are then ready for placement by the surgeon as for example shown in FIG. 2B.

Figure 4:
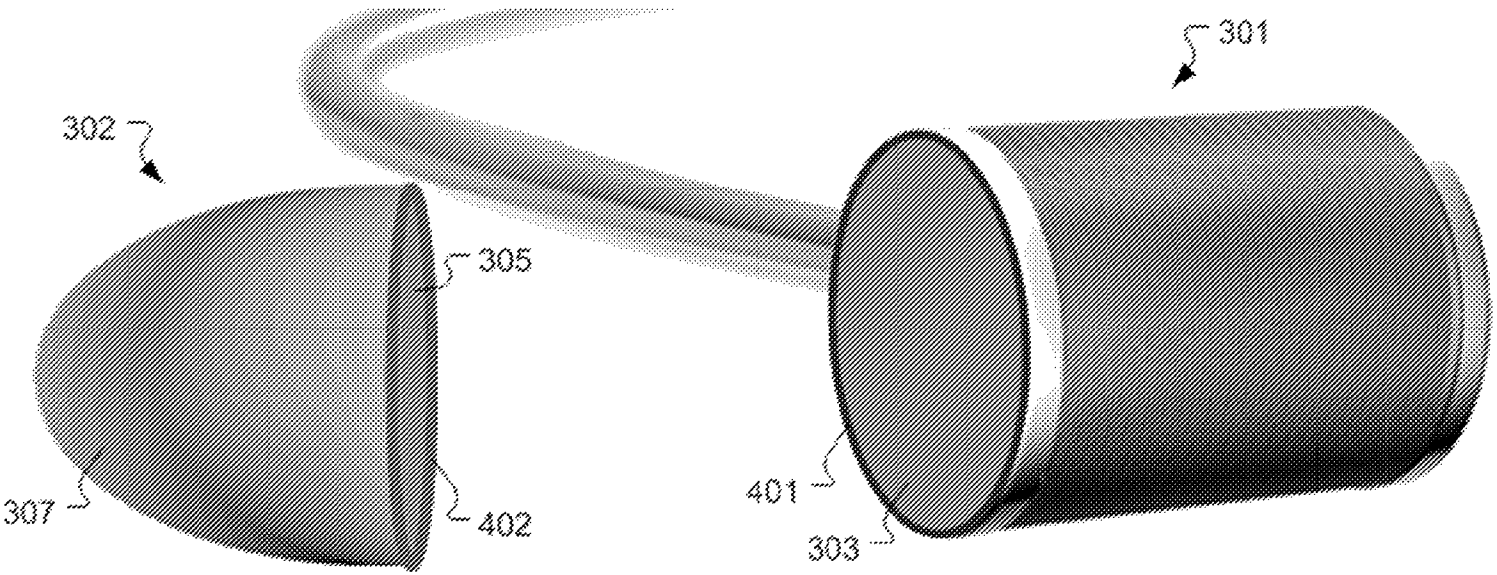
FIG. 4 shows a middle ear transducer and coupling cap that are adapted for use with an adhesive material according to another embodiment of the present invention.
Figure 5:
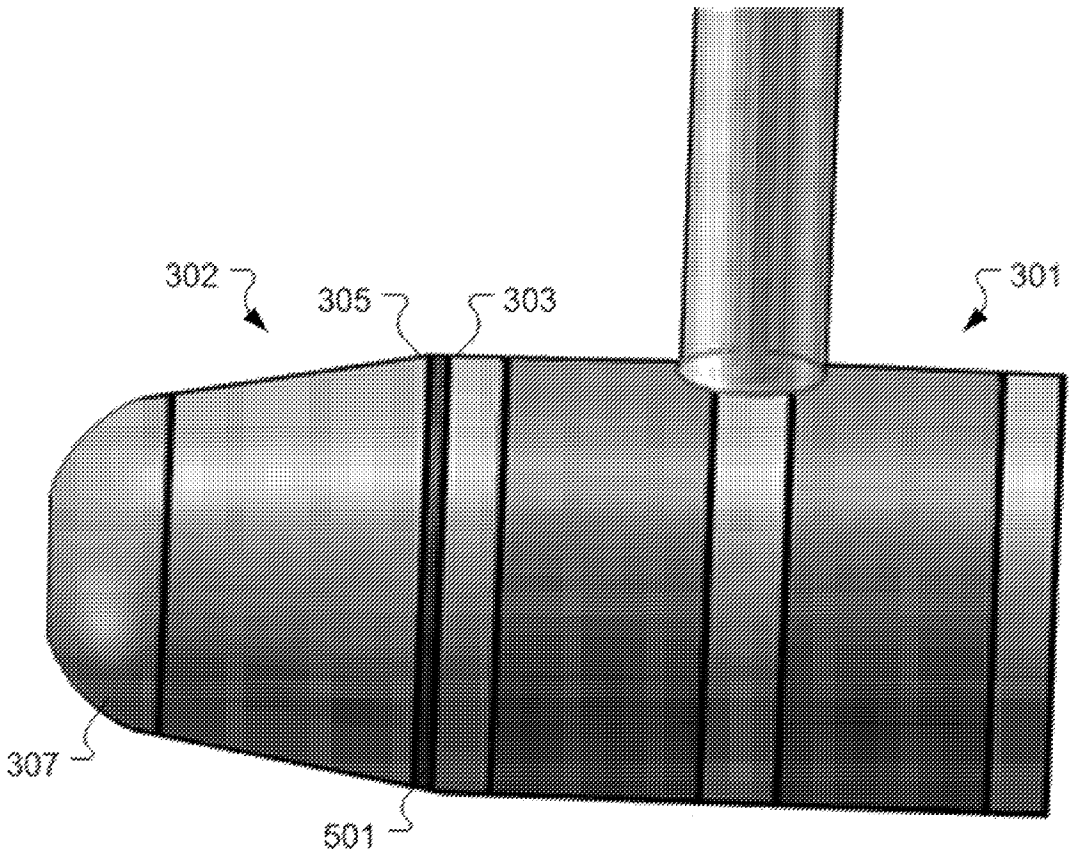
FIG. 5 shows an assembled transducer and coupling cap according to an embodiment of the present invention.

FIG. 4 shows a middle ear transducer 301 and coupling cap 302 where the adhesive features are formed based on using an adhesive ring recess 401 formed around a circumference of the cylinder end face of the transducer 301; i.e., around the transducer drive surface 303. A corresponding adhesive ring projection 402 around a circumference of the coupling drive surface 302 fits into the adhesive ring recess 401 to engage the adhesive material therein. In other specific embodiments the transducer drive surface 303 and/or the coupling drive surface 305 may be convex, which improves coupling of the mechanical stimulation signal from the transducer 301 to the coupling cap 302. Some embodiments may have both a center adhesive recess and center adhesive projection as in FIG. 3, and a circumferential adhesive ring recess and adhesive ring projection as in FIG. 4. In specific embodiments, the surfaces of the coupling drive surface 305 and the transducer drive surface 303 may be flat, convex or concave. FIG. 5 shows an example of an assembled transducer 301 and coupling cap 302.

The adhesive material may be any suitable dilutable medical grade adhesive, as for example available from Nusil Technology or Applied Silicone. Before dispensing the adhesive material onto the adhesive feature, it may be useful to dilute it with a suitable volatile substance such as N-Heptan. Then in a further step, the coupling cap 302 with the adhesive material thereon may be heated up to 60° C. to 80° C. for up to 3 hours. This ensures that the toxic dilution substance entirely evaporates. It has further been found that by heating up to 80° C. this evaporation process can be shortened to 20 minutes, effectively keeping the manufacturing time acceptably short. In addition or alternatively, it may be useful to reduce the air pressure around the transducer 301 and coupling cap 302 after joining them with the adhesive material in order to reduce the dilutant evaporation time and temperature further. This has the additional advantage of promoting the release of any micro air-bubbles that might be contained within the adhesive material. In one specific embodiment, an adhesive feature was formed from medical grade silicone diluted with N-Heptan in a ratio of 1:0.5 and then dispensed with 50 psi to achieve a proper fit into the tight manufacturing tolerances such as a 0.02 mm height of the adhesive feature after heating and evaporation (i.e. after the adhesive feature shrinks and obtains its final size).

A transducer and coupling cap such as those described above can be provided in a surgical kit for the surgeon to use during implantation surgery. If the surgeon decides during the surgery that a coupling cap is needed to properly couple the mechanical stimulation signal to the round window, then it is easy and reliable to attach the coupling cap to the transducer with a predictable amount of adhesive material without creating undesired damping and distortion. The arrangement is safe and convenient to handle without undesirably increasing the outside diameter of the transducer.

Although various exemplary embodiments of the invention have been disclosed, it should be apparent to those skilled in the art that various changes and modifications can be made which will achieve some of the advantages of the invention without departing from the true scope of the invention.

What is claimed is:

1. A middle ear transducer arrangement comprising:

an implantable transducer for converting an electrical stimulation signal into a corresponding mechanical stimulation signal, the transducer having an elongated shape with a transducer end face having:

i. a transducer drive surface adapted to produce the mechanical stimulation signal, and ii. at least one transducer adhesive feature adapted to intra-operatively receive adhesive material during surgery to implant the transducer in a recipient patient;

a coupling cap having:

i. a coupling end face including:

(1) at least one coupling adhesive feature adapted to engage the at least one transducer adhesive feature and the adhesive material to fixedly connect the coupling cap to the transducer end face, and (2) a coupling drive surface adapted for distortion-free coupling of the mechanical stimulation signal from the transducer drive surface to the coupling cap;

wherein at least a portion of the transducer drive surface and the coupling drive surface is directly connected without adhesive; and ii. a signal delivery surface for delivering the mechanical stimulation signal to an adjacent cochlear surface for sensation as sound.

2. A middle ear transducer arrangement according to claim 1, wherein at least one adhesive feature is an adhesive recess adapted to receive the adhesive material.

3. A middle ear transducer arrangement according to claim 2, wherein at least one adhesive feature is an adhesive projection adapted to engage the adhesive recess.

4. A middle ear transducer arrangement according to claim 1, wherein the adhesive features are located at a radial center of the end faces.

5. A middle ear transducer arrangement according to claim 1, wherein the adhesive features are located around a circumference of the end faces.

6. A middle ear transducer arrangement according to claim 1, wherein the transducer drive surface and the coupling drive surface are flat.

7. A middle ear transducer arrangement according to claim 1, wherein the adhesive features are rougher than the drive surfaces to promote adhesive bonding with the adhesive material.

8. A middle ear transducer arrangement according to claim 1, wherein the implantable transducer has a cylindrical shape.

9. A middle ear transducer arrangement according to claim 1, wherein the implantable transducer has a rectangular shape.

10. A middle ear transducer arrangement according to claim 1, wherein the implantable transducer is a floating mass transducer.

11. A method of creating a middle ear transducer arrangement comprising:

providing an implantable transducer for converting an electrical stimulation signal into a corresponding mechanical stimulation signal, the transducer having an elongated shape with a transducer end face having:

i. a transducer drive surface adapted to produce the mechanical stimulation signal, and ii. at least one transducer adhesive feature adapted to intra-operatively receive adhesive material; and intra-operatively fitting onto the transducer end face a coupling cap having a signal delivery surface for delivering the mechanical stimulation signal to an adjacent cochlear surface for sensation as sound, the fitting including:

i. using at least one coupling adhesive feature to engage the at least one transducer adhesive feature and the adhesive material to fixedly connect the coupling cap to the transducer end face, and ii. fitting a coupling drive surface into engagement with the transducer drive surface for distortion-free coupling of the mechanical stimulation signal free from the transducer drive surface to the coupling cap, wherein at least a portion of the transducer drive surface and the coupling drive surface is directly connected without adhesive.

12. A method according to claim 11, wherein at least one adhesive feature is an adhesive recess adapted to receive the adhesive material.

13. A method according to claim 12, wherein at least one adhesive feature is an adhesive projection adapted to engage the adhesive recess.

14. A method according to claim 11, wherein the adhesive features are located at a radial center of the end faces.

15. A method according to claim 11, wherein the adhesive features are located at around a circumference of the end faces.

16. A method according to claim 11, wherein the transducer drive surface and the coupling drive surface are flat.

17. A method according to claim 11, wherein the adhesive features are rougher than the drive surfaces to promote adhesive bonding with the adhesive material.

18. A method according to claim 11, wherein the implantable transducer has a cylindrical shape.

19. A method according to claim 11, wherein the implantable transducer has a rectangular shape.

20. A method according to claim 11, wherein the implantable transducer is a floating mass transducer.

21. A method according to claim 11, wherein using at least one coupling adhesive feature to engage the adhesive material with the at least one transducer adhesive feature includes applying heat of between 60° C. and 80° C. to promote evaporation of volatile components of the adhesive material.

22. A method according to claim 11, wherein using at least one coupling adhesive feature to engage the adhesive material with the at least one transducer adhesive feature includes reducing air pressure around the middle ear transducer arrangement.

* * * * *